US005481157A

United States Patent [19]

Takahashi

[11] Patent Number: 5,481,157

[45] Date of Patent: Jan. 2, 1996

[54] ELECTRON GUN FOR CATHODE-RAY TUBE

[75] Inventor: Chie Takahashi, Nagaokakyo, Japan

[73] Assignee: Mitsubishi Denki Kabushiki Kaisha, Tokyo, Japan

[21] Appl. No.: 221,517

[22] Filed: Apr. 1, 1994

[30] Foreign Application Priority Data

Apr. 23, 1993 [JP] Japan ..... 5-097879
Dec. 22, 1993 [JP] Japan ..... 5-324141

[51] Int. Cl.[6] ..... H01J 29/62

[52] U.S. Cl. ..... 313/409; 313/412; 313/414; 313/446; 313/452; 315/368.15

[58] Field of Search ..... 313/409, 412, 313/414, 446, 447, 448, 449, 452, 460; 315/368.15, 382

[56] References Cited

U.S. PATENT DOCUMENTS

| | | | |
|---|---|---|---|
| 4,528,476 | 7/1985 | Alig | 313/409 X |
| 5,081,393 | 1/1992 | Kinami | 313/414 X |
| 5,180,945 | 1/1993 | Kweon | 313/414 X |

FOREIGN PATENT DOCUMENTS

| | | | |
|---|---|---|---|
| 0038946 | 2/1989 | Japan | 313/409 |

OTHER PUBLICATIONS

"A New Approach To A High Performance Electron Gun Design for Color Picture Tubes," K. Hosokoshi, S. Ashizaki and H. Suzuki (IEEE Transactions on Consumer Electronics, vol. CE-26, Aug. 1980, pp. 452–458).

"High-Performance Electron Guns For Color TV—A Comparison of Recent Designs," C. A. Davis and D. L. Say (IEEE 1979, pp. 475–480).

"A Novel High-Voltage Bipotential CRT Gun Design," R. H. Hughes and H. Y. Chen (IEEE 1979, pp. 185–191).

"The 'High Voltage Bipotential' Approach To Enhanced Color Tube Performance," Donald L. Say (IEEE 1978, pp. 75–80).

"A New Form of Extended Field Lens For Use In Color Television Picture Tube Guns," A. P. Blacker, I. M. Wilson, and J. W. Schwartz (IEEE Transactions on Consumer Electronics, Aug. 1976, pp. 238–246).

"Development of Color Picture Tube With Hi-UPF Electron Gun," Institute of Electrical Communication Society Technological Research Report, 1977, DE. 77-71, pp. 1–8 (includes English translation of relevant parts).

"*Numerical calculations of focal and aberration properties of unipotential electron lenses,*" Journal of Applied Physics, vol. 48, No. 6, Jun. 1977, pp. 2306–2311.

*Primary Examiner*—Sandra L. O'Shea
*Assistant Examiner*—Ashok Patel

[57] ABSTRACT

An electron gun for the cathode-ray tube is disclosed, in which an early stage lens unit and a main lens unit are respectively constructed as a bipotential form lens. A high voltage equivalent to the voltage applied to a grid of the main lens unit is applied to a grid of the early stage lens unit thereby to reduce the space charge effect, while at the same time suppressing the change of the beam spot shape with the change in the beam current.

19 Claims, 15 Drawing Sheets

ELECTRON GUN FOR CATHODE-RAY TUBE

BACKGROUND OF THE INVENTION

1. Field of the Invention

The present invention relates to an electron gun for the cathode-ray tube in which the increase in the spot size of the electron beam with the increase in beam current is suppressed thereby to produce a satisfactory resolution in the high beam current region.

2. Description of Related Art

Generally, the electron gun for the cathode-ray tube is so constructed that the electron beam emitted from the cathode is preliminarily focused by a cathode prefocusing lens unit (also called a beam-forming region or a triode section) and an early stage lens unit making up an electron lens system, and then is caused to enter the phosphor screen to focus thereon by a main lens unit constituting the same electron lens system.

This electron lens system for the conventional cathode-ray tube electron gun is generally of two types, unipotential form lens and bipotential form lens. Other composite lens systems such as a quadra potential form (hereinafter referred to as "QPF") and a multistep potential form (hereinafter referred to as "MPF") derived from combinations of the preceding two types are also known.

A cathode-ray tube electron gun having the QPF lens is shown in FIGS. 1 and 2 as an example of the prior art. FIG. 1 is a diagram showing the basic configuration of a QPF cathode-ray tube electron gun according to the prior art, and FIG. 2 is a schematic diagram showing the arrangement of the grid electrode of the electron lens system and the light paths of the electron beam in the QPF cathode-ray tube electron gun.

In FIGS. 1 and 2, numeral 21 designates a stem, and 30 a phosphor screen, with a cathode 22, first to sixth grids 31 to 36 and a shield cap 29 arranged in that order from the stem 21 side toward the phosphor screen 30. The second grid 32 is formed in an annular shape with an electron beam aperture at the central portion thereof, and the first and third to sixth grids 31, 33 to 36 in a cylindrical shape with an electron beam aperture at both ends thereof.

The second and fourth grids 32, 34 are impressed with a cut-off voltage, the third and fifth grids 33, 35 with a Focusing voltage $E_F$, and the sixth grid 36 with a high voltage $E_b$.

The first, second and third grids 31, 32, 33 contribute to the forming of an electron beam. The area where these grids are arranged is called an electron beam-forming region or a triode, or considering the lens function obtained therefrom, a cathode prefocusing lens unit $L_1$.

In similar fashion, the third, fourth and fifth grids 33, 34, 35 constitute an early stage lens unit $L_2$ making up a unipotential form lens for focusing the electron beam irradiated from the cathode 22, and the fifth and sixth grids 35, 36 constitute a main lens unit $L_3$ providing a bipotential form lens.

The third grid 33 doubles as the cathode prefocusing lens unit $L_1$ and the early stage lens unit $L_2$, while the fifth grid 35 acts as the early stage lens unit $L_2$ and the main lens unit $L_3$, at the same time, respectively.

In this conventional QPF cathode-ray tube electron gun, as shown in FIGS. 1 and 2, the electron beam irradiated from the cathode 22 forms a crossover by being controlled by the first grid 31, the second grid 32 and the third grid 33 making up the cathode prefocusing lens unit $L_1$, is prefocused by the early stage lens unit $L_2$ made up of a unipotential form lens including the third grid 33, the Fourth grid 34 and the fifth grid 35, and further focused on the phosphor screen 30 by the main lens unit $L_3$ of bipotential form leas type constituted by the fifth grid 35 and the sixth grid 36 thereby to produce a beam spot.

FIG. 3 is a schematic diagram showing three grids $G_1$, $G_2$, $G_3$ making up a unipotential form lens used for a conventional cathode-ray tube electron gun of ordinary type. The focusing voltage $E_F$ is applied to the grids $G_l$, $G_3$ and the cut-off voltage to the grid $G_2$.

The diameter D of the intermediate grid $G_2$ and the axial length L thereof hold the relationship $L/D<2.5$ to meet the conditions as a unipotential form lens. ("Journal of Applied Physics Vol. 48, No. 6, June 1977, pp. 2306–2311")

More specifically, the unipotential form lens used for the cathode-ray tube electron gun is so constructed that the L/D for the intermediate grid $G_2$ among the three grids $G_1$, $G_2$, $G_3$ constituting the unipotential lens is set smaller than 2.5. This is also the case with the conventional cathode-ray tube electron gun shown in FIGS. 1 and 2.

Some UPF cathode-ray tube electron guns are of High-UPF type in which the axial length of the fourth grid making up the early stage lens unit is increased for a reduced spherical aberration. The length L along the axial direction of the fourth grid of this electron gun is at most 2 to 2.5 times as large as the diameter D thereof.

Important factors for determining the beam spot size on the phosphor screen of the cathode-ray tube electron gun are the repulsion of electrons due to the space charge and the spherical aberration of each electron lens system. The space charge has a large effect, in the beam-forming region (triode) where the electrons have not yet been sufficiently accelerated. The main lens unit $L_3$ where the electrons are sufficiently accelerated, on the other hand, is affected more by the spherical aberration than by the space charge.

As a conventional method of increasing the screen brightness, the beam current is increased. With the increase in beam current, however, the space charge and the spherical aberration have a synergetic effect, with the result that the beam spot size increases, thereby causing a deteriorated resolution.

As a conventional method of suppressing the effect of the space charge, on the other hand, a high-voltage source is located in the vicinity of the triode so that the electrons are accelerated sharply to reduce the emittance affecting the beam quality. The UPF cathode-ray tube electron gun and the High-UPF cathode-ray tube electron gun, for example, employ a configuration in which a high voltage is applied to the third grid 33. These cathode-ray tube electron guns, as compared with the MPF, QPF or BPF cathode-ray tube electron gun, are known to have superior beam spot characteristics in the high-beam current region. ("Development of Color Cathode-Ray Tube with Hi-UPF Electron Gun", Institute of Electrical Communication Society Technological Research Report, 1977, ED. 77–71, pp. 1 to 8)

On the other hand, a known effective method of reducing the spherical aberration of an electron lens is to increase the effective diameter of the conventional lens. In the delta-type cathode-ray tube electron gun, for example, the possibility of increasing the lens diameter permits a superior focusing performance. The in-line electron gun, which is the main stream of electron guns in recent years for its assembly ease, however, uses a self-convergence system with an electrode configuration of three electron beams aligned in horizontal direction, and therefore poses the problem of the difficulty of increasing the lens diameter. Thus, with regard to the inline electron gun, in order to reduce the spherical aberration, efforts are being made to optimize the electrode profile and the applied voltage, with emphasis placed on the development of a large-size composite lens, an expansive electric field lens, etc., as the main lens unit.

No measure has yet been taken to cope with the increase in beam spot size with the increase in beam current.

SUMMARY OF THE INVENTION

The invention has been developed in order to obviate the above-mentioned problems and an object thereof is to provide a cathode-ray tube electron gun in which the increased spot size with the increase in current is suppressed to secure a satisfactory resolution in high current region while at the same time maintaining a small change in the beam spot size against current change.

According to one aspect of the invention, there is provided a cathode-ray tube electron gun comprising an early stage lens unit and a main lens unit constituting a bipotential form lens, respectively. Thus when one of the grids making up the early stage lens unit is impressed with the substantially same level of high voltage as the grid constructing the main lens, the electron beam in the beam-forming region is sharply accelerated, so that the expansion of the electron beam is suppressed thereby reducing the space charge effect. Also, the emittance value reflecting the quality of the electron beams is reduced, so that the change in the beam spot size with the beam current is suppressed for an improved resolution.

According to another aspect of the invention, there is provided a cathode-ray tube electron gun comprising an early stage lens unit and a main lens unit configured as a bipotential form lens, respectively, wherein the center distance between the two types of lenses is at least 5.6 times larger than the size of the beam aperture located at the early stage lens unit side of the grids making up the early stage lens unit. As a consequence, the bipotential form lens characteristic of the main lens unit is matched with that of the early stage lens unit, so that the operation of the two lenses are maintained independent of each other thereby to maintain the superior characteristics of the respective lenses.

According to still another aspect of the invention, there is provided a cathode-ray tube electron gun comprising an early stage lens unit and a main lens unit making up a bipotential form lens, respectively, wherein the thickness of an annular grid constituting the cathode prefocusing lens unit is one half or less of the beam aperture size thereof. As a result, one of the grids making up the early stage lens unit is located nearer to the annular grid of the cathode prefocusing lens unit, thereby reducing the imaginary object point size sufficiently for a reduced beam spot size on the object of projection.

According to a further aspect of the invention, there is provided a cathode-ray tube electron gun comprising an early stage lens unit and a main lens unit, each of bipotential type, wherein the length of a grid making up the early stage lens unit is one half or less of the beam aperture size at the main lens side of the particular grid. As a consequence, the lens action as a deceleration-type bipotential Form lens in the early stage lens unit can be appropriately suppressed. Beyond the one-half threshold, the focusing strength of the early stage lens unit increases excessively, resulting in an increased magnification, a deteriorated emittance characteristic, and undesirable blooming.

Another object of the invention is to provide a cathode-ray tube electron gun in which the expansion of the electron beam is suppressed to reduce the beam spot size of the peripheral portion on the object of projection, thereby to reduce the difference in focus between the peripheral and central portions.

According to one aspect of the invention, there is provided a cathode-ray tube electron gun comprising an early stage lens unit and a main lens unit making up a bipotential form lens, respectively, wherein the potential gradient on the axis between the annular grid and a grid constituting the early stage lens unit on the object side of the cathode refocusing lens unit is 13 kV/mm or more. As a result, the electron beam is sharply accelerated in the beam forming region thereby to prevent expansion thereof. This reduces the space charge effect especially in the high-beam current region thereby to reduce the change in the beam spot size with the change in beam current. In the case where the potential gradient on the axis is 13 kV/mm or more, the beam spot size is reduced by about 10% as compared with the prior art.

According to another aspect of the invention, there is provided a cathode-ray tube electron gun, wherein the potential gradient is 13 kV/mm or more, and the thickness of an annular grid making up the cathode prefocusing lens unit is substantially ⅓ to ½ of the beam aperture size.

Thus, the lens strength which otherwise might be reduced with the increase in the potential gradient is prevented from decreasing by controlling the thickness of the annular grid, thereby reducing the beam diameter at the deflection center. The beam spot size at the peripheral portion of the object of projection is reduced in proportion to the beam diameter at the deflection center, and therefore the difference in focus performance between the central and peripheral portions is reduced.

When the ratio between the thickness of the annular grid arid the beam aperture size exceeds ½, the center/periphery ratio of the beam spot size increases in the low beam current region, and so does the center/periphery ratio in the high beam current region. In the case where the ratio between the thickness of the annular grid and the beam aperture size is smaller than ⅓, on the other hand, the center/periphery ratio decreases in the low beam current region. Since the center/periphery ratio in the high beam current region does not decrease as much, however, there is an increased difference between the low beam current region and the high beam current region. Further, in the case where the difference in center/periphery ratio between the low beam current region and the high beam current region is reduced more than the values obtained according to the first to fourth aspects of the invention, the ratio between the thickness of the annular grid and the beam aperture size is desirably set substantially in the range of ⅜ to 9/20.

The above and further objects and features of the invention will more fully be apparent from the following detailed description with accompanying drawings.

DESCRIPTION OF THE PREFERRED EMBODIMENTS

The invention will be explained specifically below with reference to the accompanying drawings.

Figure 1:
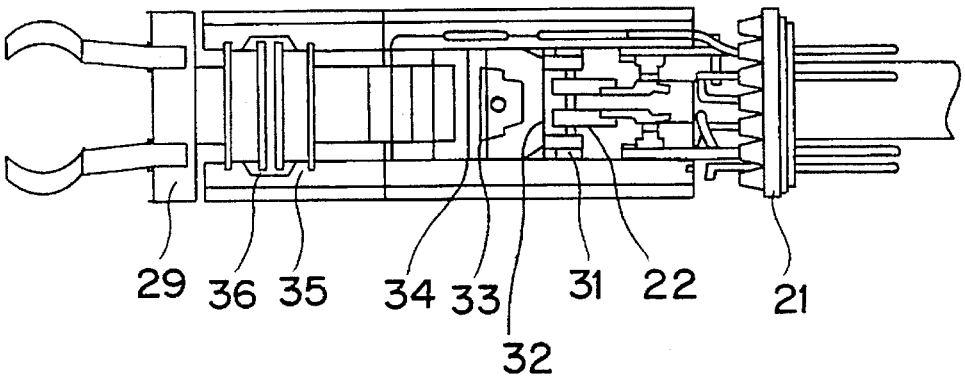
Fig. 1 PRIOR ART
FIG. 1 is a diagram for explaining a conventional QPF cathode-ray tube electron gun.
Figure 4:
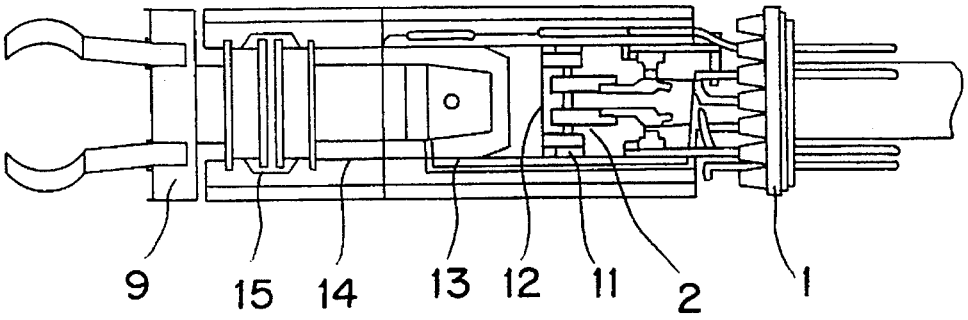
FIG. 4 is a diagram showing the basic configuration of a cathode-ray tube electron gun according to the invention.
Figure 2:
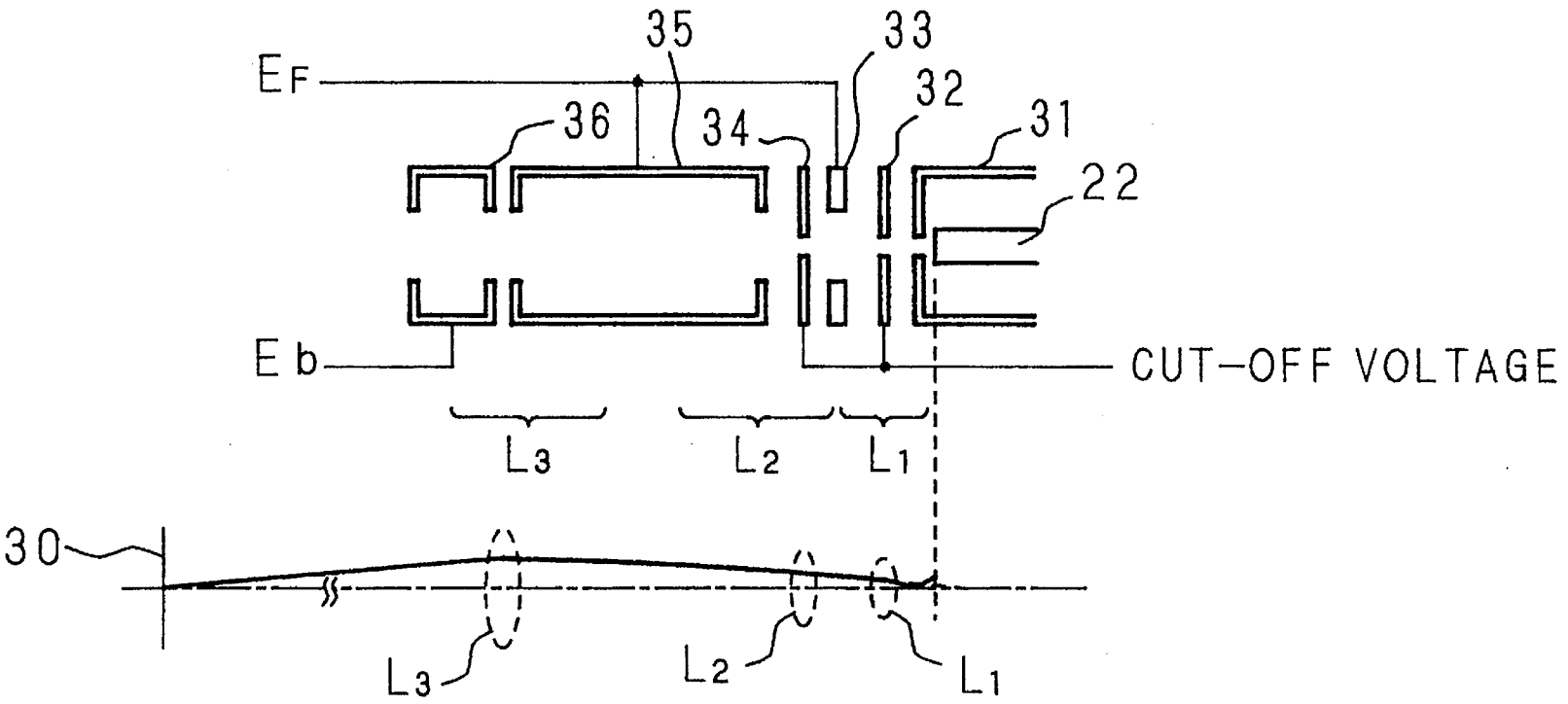
Fig. 2 Prior Art
FIG. 2 is a diagram for explaining an ordinary unipotential form lens.
Figure 3:
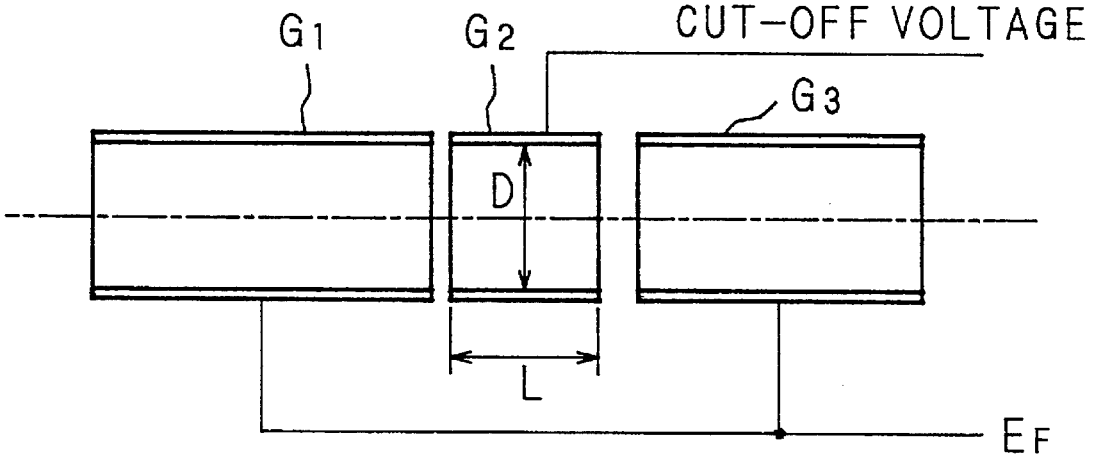
Fig. 3 Prior Art
FIG. 3 is a model diagram showing grids constituting a conventional unipotential form lens.
Figure 5:
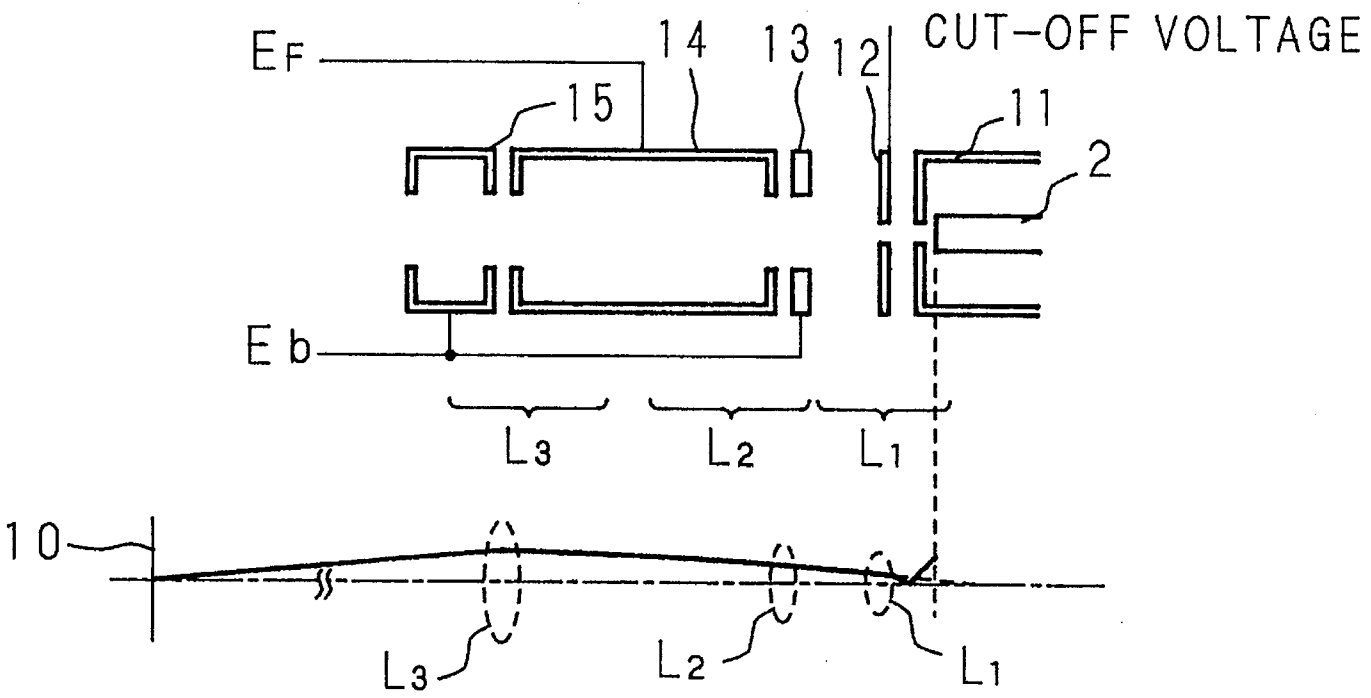
FIG. 5 is a model diagram showing the arrangement of grids and the light path of the electron beam.

FIG. 4 is a diagram showing the basic configuration of a cathode-ray tube electron gun according to the invention. FIG. 5 is a schematic diagram showing the arrangement of the grids making up the electron gun and the light paths of the electron beam.

In FIG. 4, numeral 1 designates a stem, and numeral 10 a phosphor screen. A cathode 2, a first grid 11, a second grid 12, a third grid 13, a fourth grid 14, a fifth grid 15 and a shield cap 9 are arranged in that, order from the stem 1 side toward the phosphor screen 10. Of all the first to fifth grids 11 to 15, the second grid 12 is formed annular shape, and the first and third to fifth grids are formed cylindrically with beam apertures at the longitudinal ends thereof. The second grid 12 is impressed with a cutoff voltage, the fourth grid 4 with the focusing voltage $E_F$ and the third and fifth grids 13, 15 with the high voltage $E_b$, respectively.

In this way, the cathode prefocusing lens unit $L_1$ is configured of the first, second and third grids 11, 12, 13, the early stage lens unit. $L_2$ of deceleration type bipotential form lens of the third and fourth grids 13, 14, and the main lens unit $L_3$ of acceleration type bipotential form lens of the fourth and fifth grids 14, 15.

The third grid 13 is shared by the cathode prefocusing lens unit $L_1$ and the early stage lens unit $L_2$ on one hand, and the fourth grid 14 by the early stage lens unit $L_2$ and the main lens unit $L_3$ on the other.

The third grid 13 is impressed with the same high voltage is applied to the fifth grid 15 in order to suppress the multiplicity of the applied voltages, i.e., in order to reduce the types of applied voltage. The reduced number of types of applied voltages reduces the number of component parts, thereby facilitating the assembly work.

Also, the application of a high voltage to the third grid 13 reduces the product of the image magnification and the angular magnification of the early stage lens unit $L_2$, while at the same time improving the beam spot size in the high beam current region when the early stage lens unit $L_2$ is combined with a high-performance large-sized lens with little spherical aberration employed in the conventional cathode-ray tube electron gun. In addition, (A) The thickness of the second grid 12 (the axial thickness of the grid electrode formed in annular shape) is not more than one half of the beam aperture open to the central portion.

(B) The length of the third grid 13 (the axial length of the grid formed in cylindrical shape) is not more than one half of the beam aperture at the fourth grid 14 side of the third grid 13.

(C) The length of the Fourth grid 14 (the axial length of the fourth grid 14 formed in cylindrical shape) is set to be at least 5.6 times as large as the beam aperture size at the third grid 13 side of the fourth grid 14.

Now, explanation will be made about specific numeric values and constraints thereof with regard to the thickness of the second grid 12 and the lengths of the third grid 13 and the fourth grid 14 described above.

(A) The thickness of the second grid 12 is made not more than one half of the beam aperture size because the high-voltage third grid 13 is placed in the vicinity of the cathode 2 to reduce the imaginary object point size. A sufficient reduction of the imaginary object point size cannot be obtained when the thickness of the second grid 12 exceeds one half of the beam aperture.

The imaginary object point size is defined as the diameter of the object point as viewed from the main lens.

Assuming that the beam aperture size of the second grid 12 is 0.64 mm, the thickness of the second grid 12 is approximately 0.1 mm or not more than one half of the beam aperture size. In contrast, the thickness of the second grid 32 of the conventional cathode-ray tube electron gun is about 0.45 mm.

Figure 6:
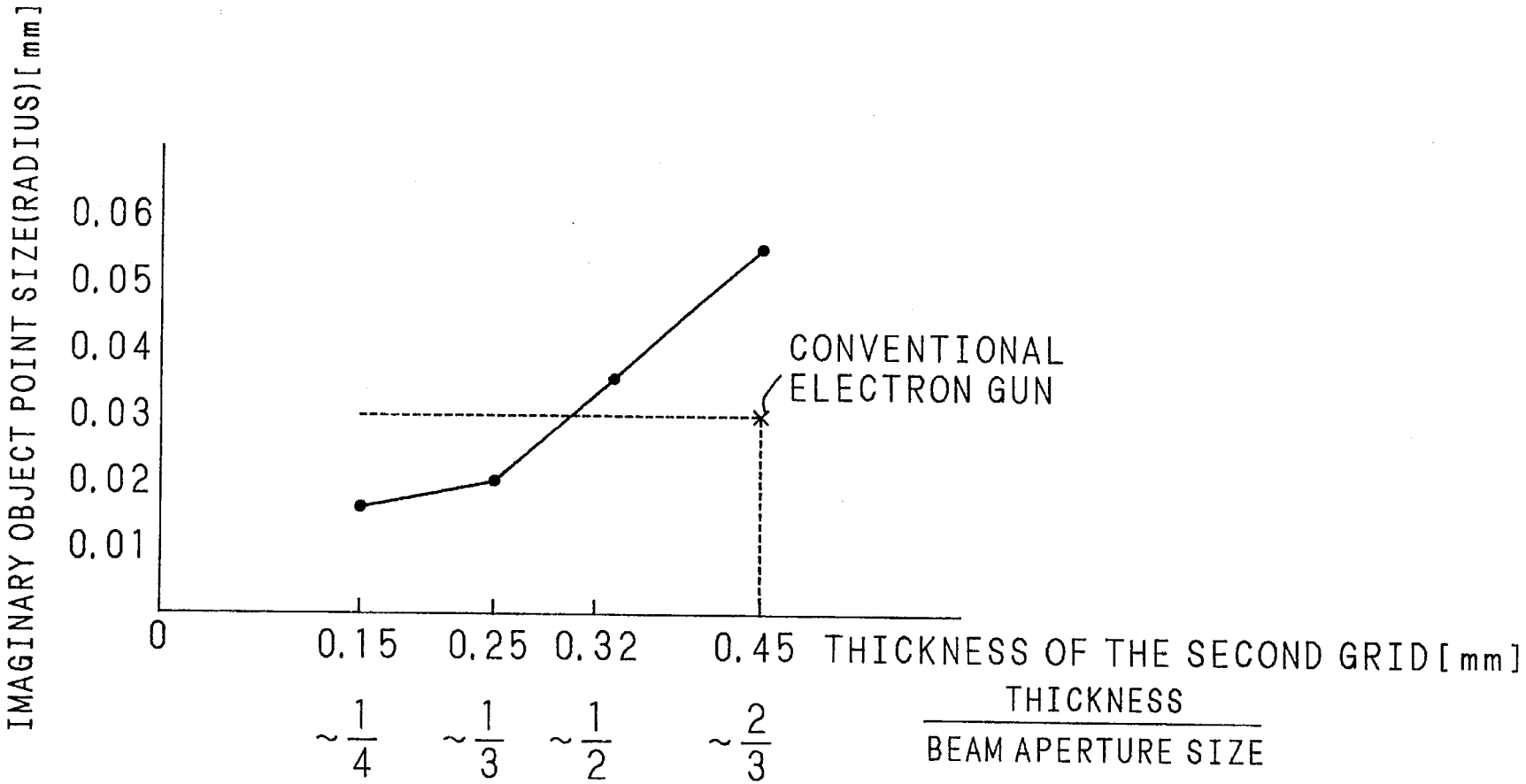
FIG. 6 is a graph showing the result of simulation determined by the computer about the dependency of the imaginary object point size on the thickness of the second grid.

FIG. 6 is a graph showing the dependency of the imaginary object point size on the thickness of the second grid at the beam current $I_K$ of 500 μA, as determined by electromagnetic field analysis on the computer. The abscissa represents the thickness (mm) of the second grid 12 and the ratio between the thickness of the second grid and the beam aperture size of the second grid, while the ordinate plots the imaginary object point size (in terms of radius). The cross in the graph designates the imaginary object point size (radius) of the conventional cathode-ray tube electron gun (with the second grid thickness of 0.45 mm).

It is clearly understood from this graph that the imaginary object point size can be very effectively reduced by setting the ratio of the thickness of the second grid to the aperture size of the second grid to less than ½, or preferably less than ⅓.

Figure 7:
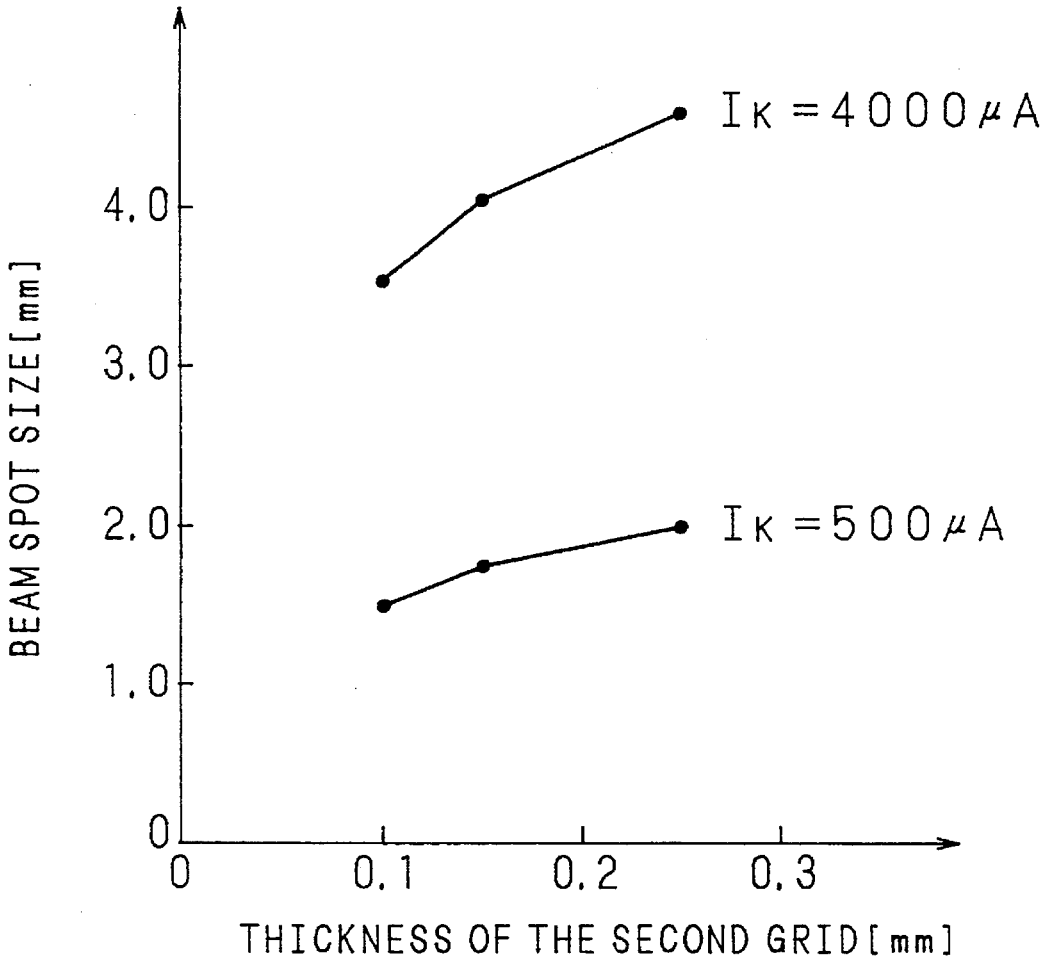
FIG. 7 is a graph showing the result of a comparison test conducted on the dependency of the beam spot size on the thickness of the second grid in a cathode-ray tube electron gun according to the invention and a conventional counterpart.

FIG. 7 is a graph showing the thickness of the second grid 12 and the beam spot size on the phosphor screen as experimentally obtained at the beam current $I_K$ of 500 μA and 4000 μA respectively. The abscissa represents the thickness in mm of the second grid 12 and the ordinate the beam spot size in mm on the phosphor screen.

As will be seen from this graph, the beam spot size is considerably reduced in the high beam current region of 4000 μA as well as in the beam current region of 500 μA at the thickness not more than 0.25 mm of the second grid 12.

(B) The length of the third grid is made not more than one half of the beam aperture size on the fourth grid 14 side thereof is in order to suppress the lens action of the early stage lens unit $L_2$ as a deceleration-type bipotential form lens. When the length of the third grid exceeds one half of the beam aperture size, the potential difference between the third grid 13 and the fourth grid 14 would become so large that the focusing force at the early stage lens unit $L_2$ formed thereby becomes excessive, with the result that not only an increased magnification but also an deteriorated emittance characteristic and the blooming would be caused.

The first means for weakening the focusing force of the early stage lens unit $L_2$ is to shorten the length of the third grid 13. In an extreme case, the third grid 13 is constructed in annular form similar to the second grid 12. Another conceivable means is to increase the beam aperture size of the third grid on the second grid 12 side. Although either means will do, explanation will be made specifically below with reference to the case in which the length of the third grid 13 is shortened.

Suppose that the beam aperture size of the third grid 13 on the fourth grid 14 side is 4.3 mm. The length of the third grid 13 is about 1.2 mm, or not more than one half thereof, on condition that the length of the second grid 12 is 0.15 mm.

The length of the third grid 33 of the conventional cathode-ray tube electron gun is 3.35 mm when the thickness of the second grid 32 is 0.45 mm.

Figure 8:
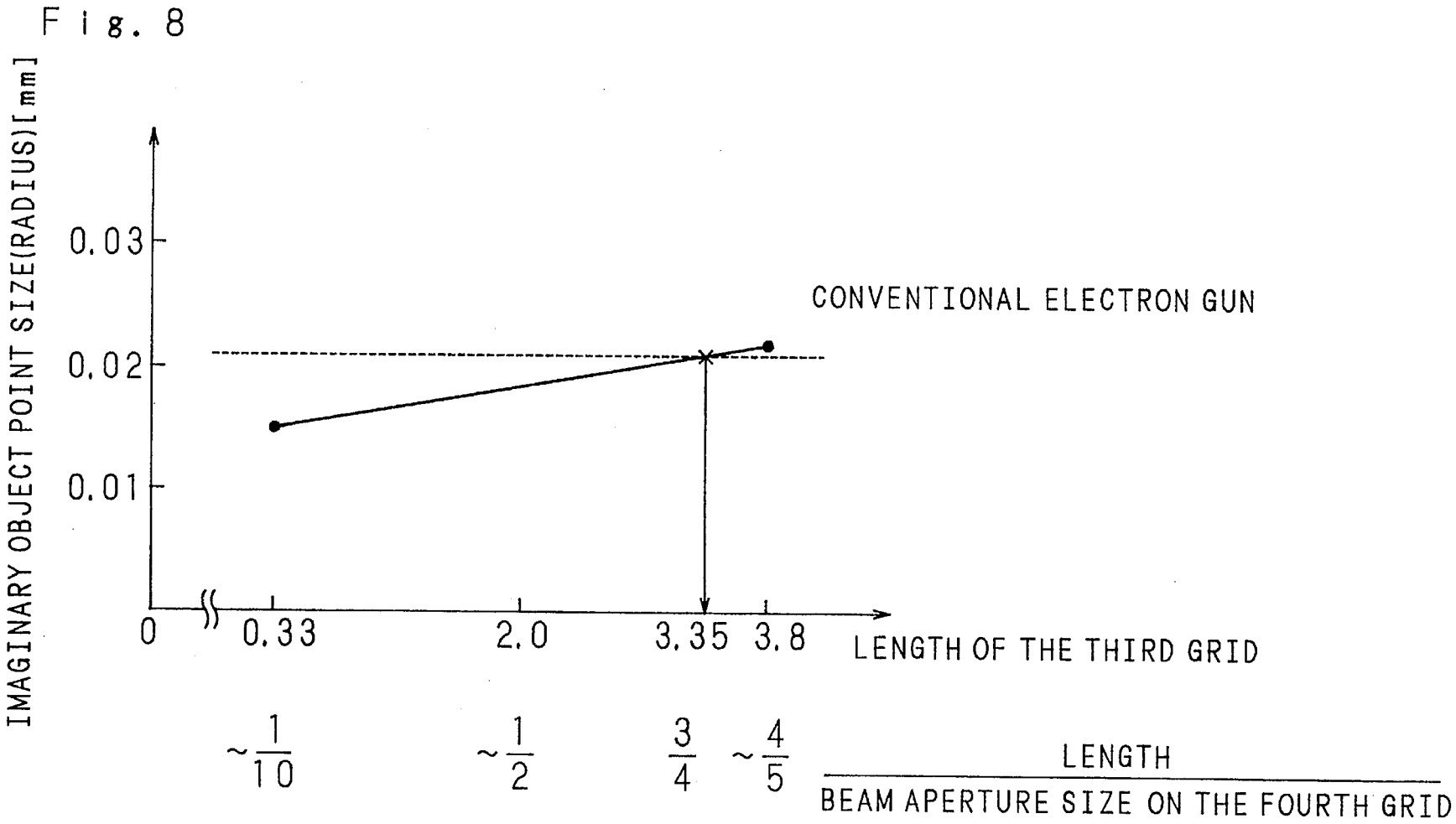
FIG. 8 is a graph showing the result of simulation made by the computer about the dependency of the imaginary object point size on the length of the third grid.

FIG. 8 is a graph showing the dependency of the imaginary object point size (radius) on the length of the third grid 13 as determined by electromagnetic field analysis on the computer. The abscissa represents the length (mm) of the third grid 13 and the ratio of the length of the third grid to the beam aperture size (4.3 mm) of the third grid 13 on the fourth grid 14 side. The ordinate plots the imaginary object point size (mm). In the graph, the cross indicates the imaginary object point size (expressed in terms of radius) of the conventional cathode-ray tube electron gun (with the length 3.35 mm of the third grid 33).

As seen from this graph, the imaginary object point size is remarkably reduced when the ratio of the length of the third grid 13 to the beam aperture size of the fourth grid 14 side is ¾ or less, or desirably ½ or less.

(C) The length of the fourth grid 14 is made 5.6 or more times as large as the beam aperture size of the fourth grid 14 on the third grid 13 side for the reason that follows. The early stage lens unit $L_2$ is constructed as a deceleration-type bipotential form lens. Also, in combined use with the main lens unit $L_3$ configured of the large-sized composite lens for the conventional cathode-ray tube, the bipotential form lens characteristic of the main lens unit $L_3$ for the conventional cathode-ray Lube electron gun is matched with that of the early stage lens unit $L_2$ of the cathode-ray tube electron gun according to the invention. The superior characteristics of the respective lenses are thus maintained, and with the fourth grid 14 interposed, the independent lens action of the lenses formed on both sides thereof is maintained.

First, in order to configure the early stage lens unit $L_2$ as a deceleration-type bipotential form lens, the length of the fourth grid 14 is made 2.5 or more times as large as the diameter of the main lens unit $L_3$.

The equivalent effective lens size of the large-sized composite lens of the conventional cathode-ray tube electron gun is approximately 8 to 9 mm. If the relation L/D>2.5 is to be satisfied, the length L of the fourth grid 14 is made $$L>9\times2.5\approx22.5$$

Since the effective lens diameter is involved, however, it is difficult to define the electrode length of the fourth grid 14 by the equivalent effective lens diameter of the main lens unit $L_3$. When the beam aperture size D of the fourth grid 14 on the third grid 13 side is used for the definition, the requisite is that L/D>5.6 from L/D= 22.5/4≈5.6 providing the constraint imposed by the main lens unit $L_3$.

In this way, the early stage lens unit $L_2$ is configured as a deceleration-type bipotential form lens, and the main lens unit $L_3$ is constructed as an acceleration-type bipotential form lens as in the prior art. Since both the early stage lens unit $L_2$ and the main lens unit $L_3$ are thus configured as a bipotential form lens with the lens centers sufficiently distant from each other, the mutual interference is attenuated. As a result, the divergence angle of the beam entering the main lens unit $L_3$ can be designed independently. Also, the longer focusing electrode reduces the magnification of the main lens unit $L_3$ for an improved focusing characteristic.

in the case where the beam aperture size D on the third grid 13 side of the fourth grid 14 is about 4 mm, the length L of the fourth grid 14 is about 27 mm.

As a result, the ratio L/D for the fourth grid 14 of the cathode-ray tube electron gun according to the invention is 27/4≈6.5, which is considerably larger than the L/D< 2.5 for the fourth grid of the conventional cathode-ray tube electron gun. The early stage lens unit $L_2$ is thus a bipotential form lens.

Figure 9:
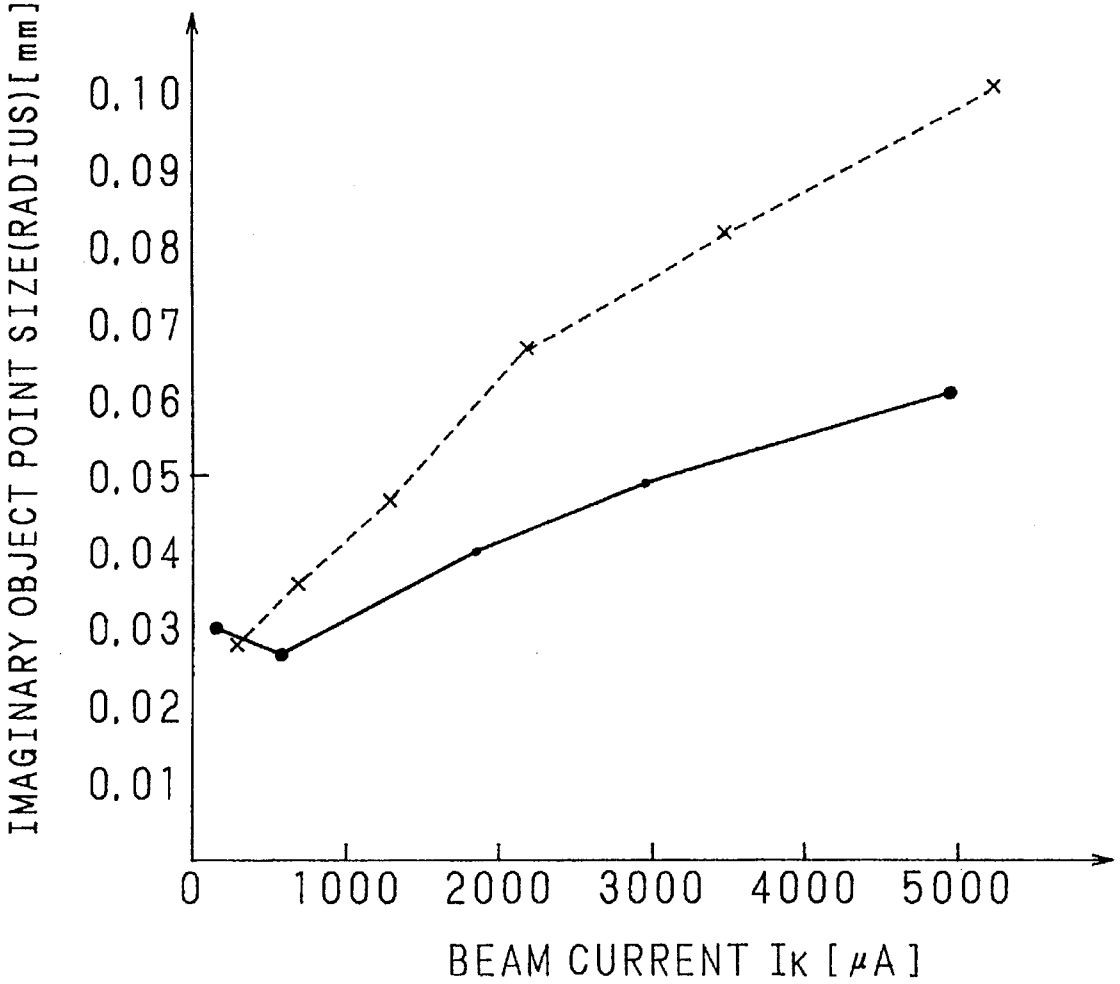
FIG. 9 is a graph showing the relationship between the beam current and the imaginary object point size in the electron guns according to the invention and the prior art respectively, as determined by computer from the electromagnetic field analysis.
Figure 10:
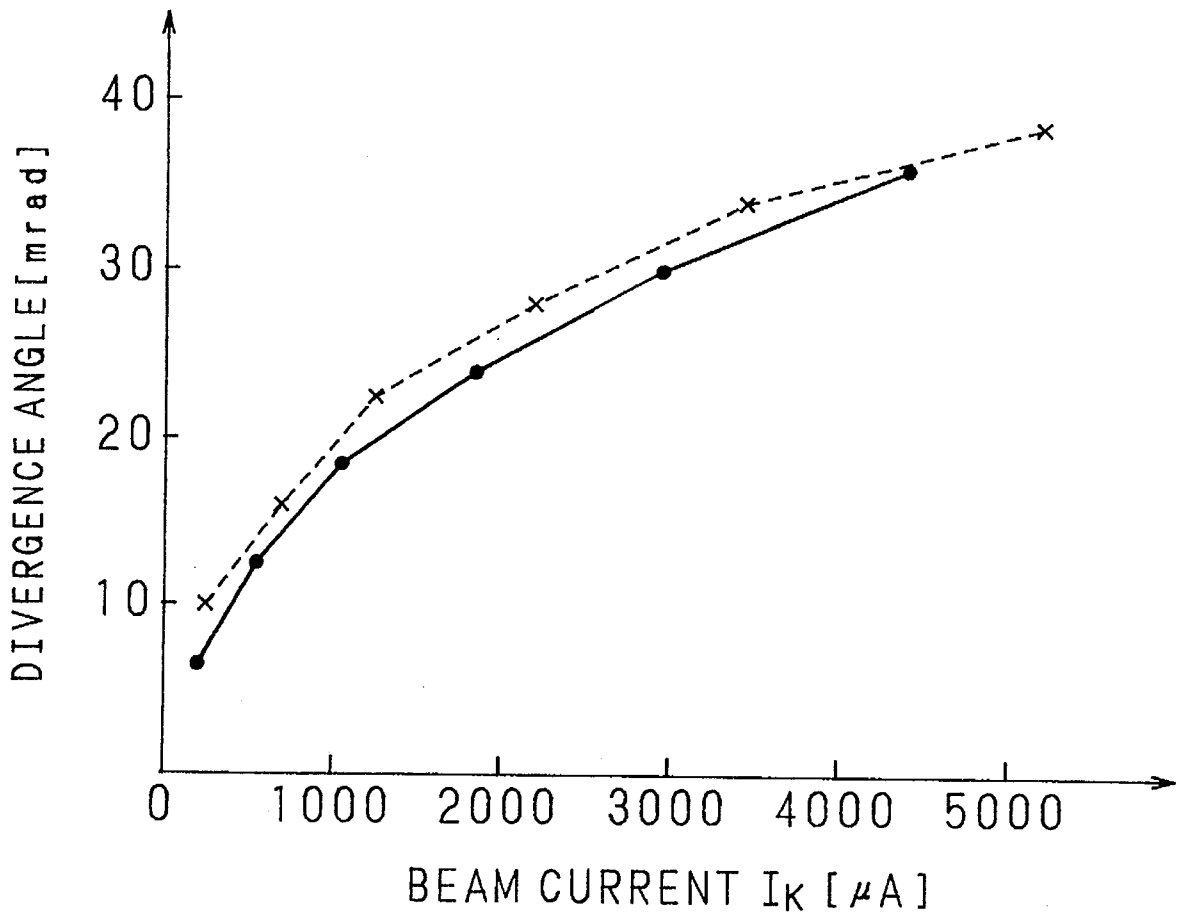
FIG. 10 is a graph showing the relationship between the beam current and divergence angle in the electron guns according to the invention and the prior art as determined by computer from the electromagnetic field analysis.

FIGS. 9 and 10 show the relationship between the beam current $I_K$, the imaginary object point size and the divergence angle for the cathode-ray tube electron gun according to the invention (hereinafter referred to as "the product according to the invention") and the conventional cathode-ray tube electron gun (hereinafter referred to as "the conventional product") as determined by the electromagnetic field analysis using the computer.

The product according to the invention employs a conventional large-size composite lens of bipotential form as the main lens unit. The conventional product, on the other hand, is of QPF type.

In FIG. 9, the abscissa represents the beam current $I_K$ (μA) and the ordinate the imaginary object point size (mm). In the graph, the solid line shows the curve for the product according to the invention, and the dashed line that for the conventional product. As obvious from this graph, the imaginary object point diameter for the product, according to the invention is considerably reduced in the high-beam current region of 500 μA or more in beam current $I_K$.

FIG. 10 is a graph showing the relationship between beam current and divergence angle for the product according to the invention and the conventional product. The abscissa represents the beam current $I_K$ (μA), and the ordinate the divergence angle (mrad). In the graph, the solid line applies to the product according to the invention, and the dashed line to the conventional product. As will be understood from the graph, the divergence angle for the product according to the invention is reduced as compared with the conventional product in the range of 1000 to 4000 μA in beam current $I_K$.

Figure 11:
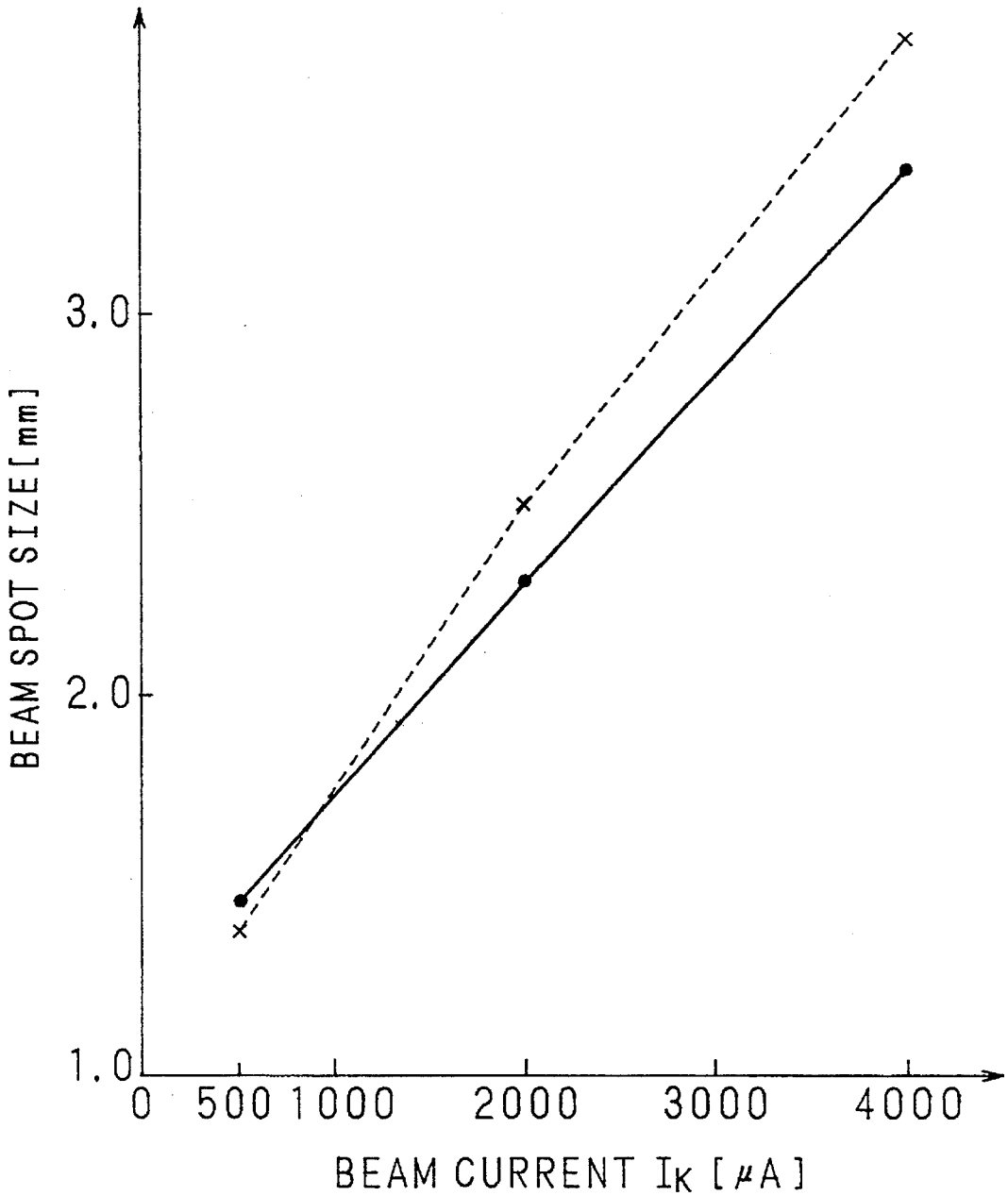
FIG. 11 is a graph showing the result of a comparison test conducted for determining the beam spot size at the screen center for the electron guns according to the invention and the prior art.

FIG. 11 is a graph representing the result of a comparison test conducted on the beam current and the beam spot size between the product according to the invention and the conventional product. The abscissa represents the beam current $I_K$ (μA), and the ordinate the beam spot size in mm. In the graph, the solid line covers the product according to the invention and the dashed line the conventional product. In the actual test, the beam spot size at the screen center was measured with the product according to the invention and the conventional product each built in a laterally-long 28-inch color television tube.

With the product according to the invention in which the same high voltage is applied to the third grid 13 as to the fifth grid 15, the interval between the second grid 12 and the third grid 13 was expanded from 0.8 mm to 3.0 mm in view of the need of securing the pressure resistance between the grids, the other conditions being the same as those for the conventional product.

As is clear from FIG. 11, the beam spot size of the product according to the invention is considerably reduced as compared with that of the conventional product in the high-beam current region of 1000 to 4000 μA with the beam current of $I_K$. It is thus seen that a satisfactory beam spot size is obtained, and that the beam spot size is changed less with the changes of the beam current.

Now, the cathode-ray tube electron gun according to another embodiment of the invention will be explained.

This embodiment, with a configuration similar to that of the embodiment shown in FIG. 4, includes a first grid 11 having the thickness of 0.08 mm and the aperture diameter of 0.64 mm, a second grid 12 having the thickness of 0.25 mm (or 0.35 mm) and the aperture diameter of 0.64 mm, a third grid 13 having the electrode length of 15 mm and the aperture diameter of 1.5 mm, a fourth grid 14 having the electrode length of 51.8 mm, and a fifth grid 15 having the electrode length of 10 mm. The intervals between the grids are as follows: 0.08 mm between the cathode 2 and the first grid 11, 0.41 mm between the first grid 11 and the second grid 12, 2.0 mm between the second grid 12 and the third grid 13, 1.6 mm between the third grid 13 and the fourth grid 14, and 1.6 mm between the fourth grid 14 and the fifth grid 15.

A cut-off voltage of 0 V is applied to the first grid 11, a cut-off voltage of 700 V to the second grid 12, a focusing voltage $E_F$ variable between 7.5 and 8.5 kV to the fourth grid 14, and a high voltage $E_b$ of 32 kV to the third and fifth grids 13, 15.

The electron beam in the beam-forming region can be sharply accelerated by narrowing the distance between the second grid 12 and the third grid 13. In this case, the lens power of the cathode prefocusing lens unit $L_1$ is weakened as compared with the prior art. According to the embodiment under consideration, in order to reduce the space charge effect, the distance between the second grid 12 and the third grid 13 is set to 2.0 mm in such a manner as to attain the axial potential gradient of 13 kV/mm or more between the second grid 12 and the third grid 13.

Also, the thickness of the second grid 12 is larger than that in the aforementioned embodiment in order to minimize the ratio between the beam spot size at the screen center and the beam spot size at the screen periphery.

The reason for the above-mentioned numerical constraints is described below.

Figure 12:
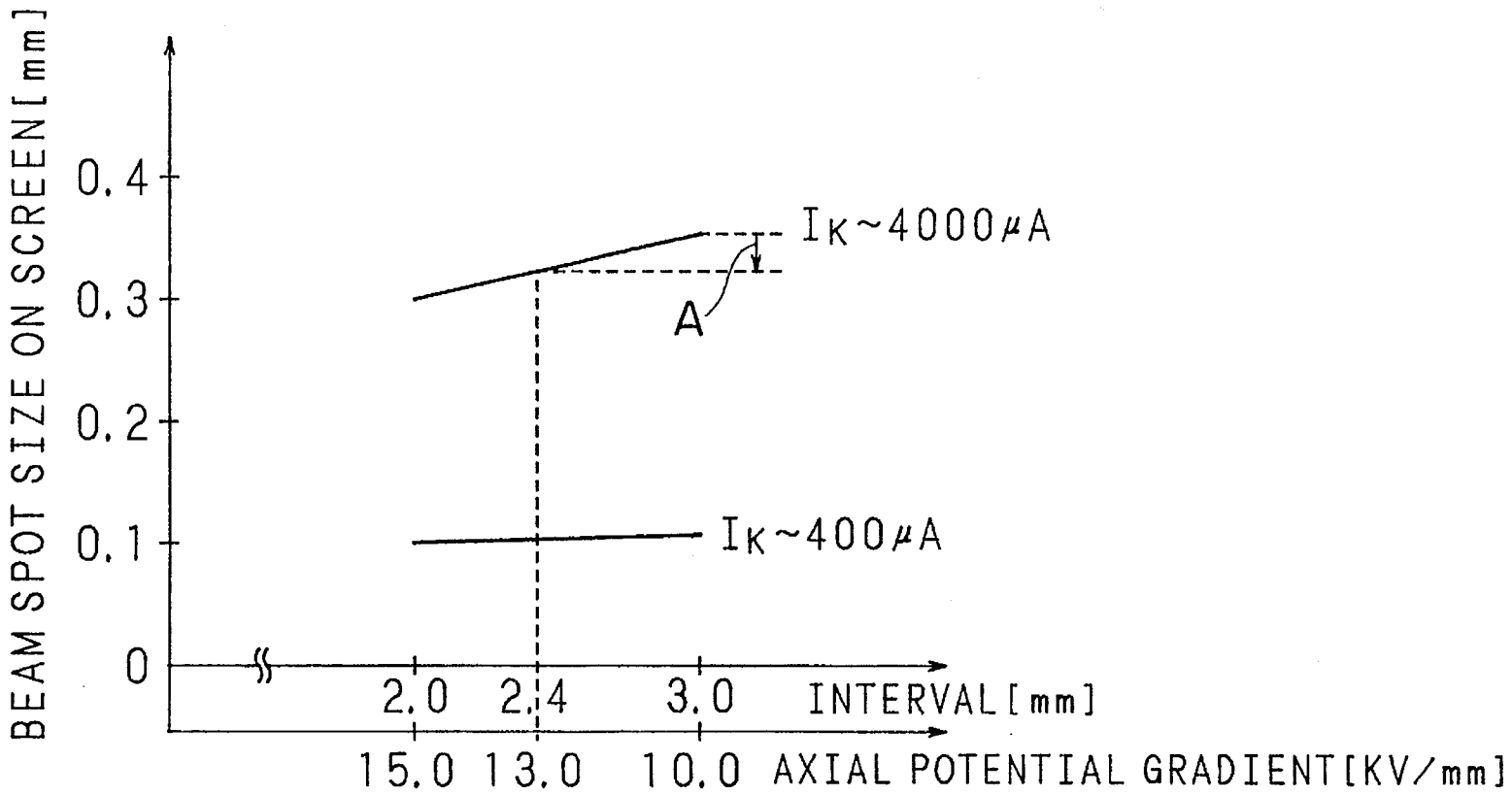
FIG. 12 is a graph showing the relationship between the interval between the second and third grids and the beam spot size on the phosphor screen.

FIG. 12 is a graph showing the relationship held between the interval between the second grid 12 and the third grid 13 and the beam spot size at the screen center at the beam current $I_K$ of 400 μA (low-beam current region) and 4000 μA (high-beam current region), as determined by the electromagnetic field analysis and the beam trajectory analysis on the computer. The ordinate represents the beam spot size on the screen, and the abscissa the interval and the potential gradient. In view of the fact that the brightness visible to human eyes is 5% or more, the beam spot size at 5% in brightness (hereinafter referred to as "the 5% profile") is evaluated. As seen from this graph, the beam spot size in the high-beam current region can be reduced by about 10% from the aforementioned embodiment (with the interval of 3.0 mm) by reducing the interval between the second grid 12 and the third grid 13 to 2.4 mm. More specifically, in the case where the interval between the second grid 12 and the third grid 13 is made to secure at least 13 kV/mm of axial potential gradient, the beam spot size on the phosphor screen 10 in the high-beam current region can be sufficiently reduced, thereby making it possible to reduce the change in beam spot size with current.

Also, the lens power of the cathode prefocusing lens $L_1$ is weakened by narrowing the interval between the second grid 12 and the third grid 13 as described above. With the weakening of the lens power, the beam size is increased at the deflection center, resulting in a greater liability to succumb to the effect of deflection aberration. The spot size around the screen periphery is then undesirably increased. In order to suppress this tendency, the thickness of the second grid 12 is increased to increase the lens power of the cathode prefocusing lens $L_1$.

Figure 13:
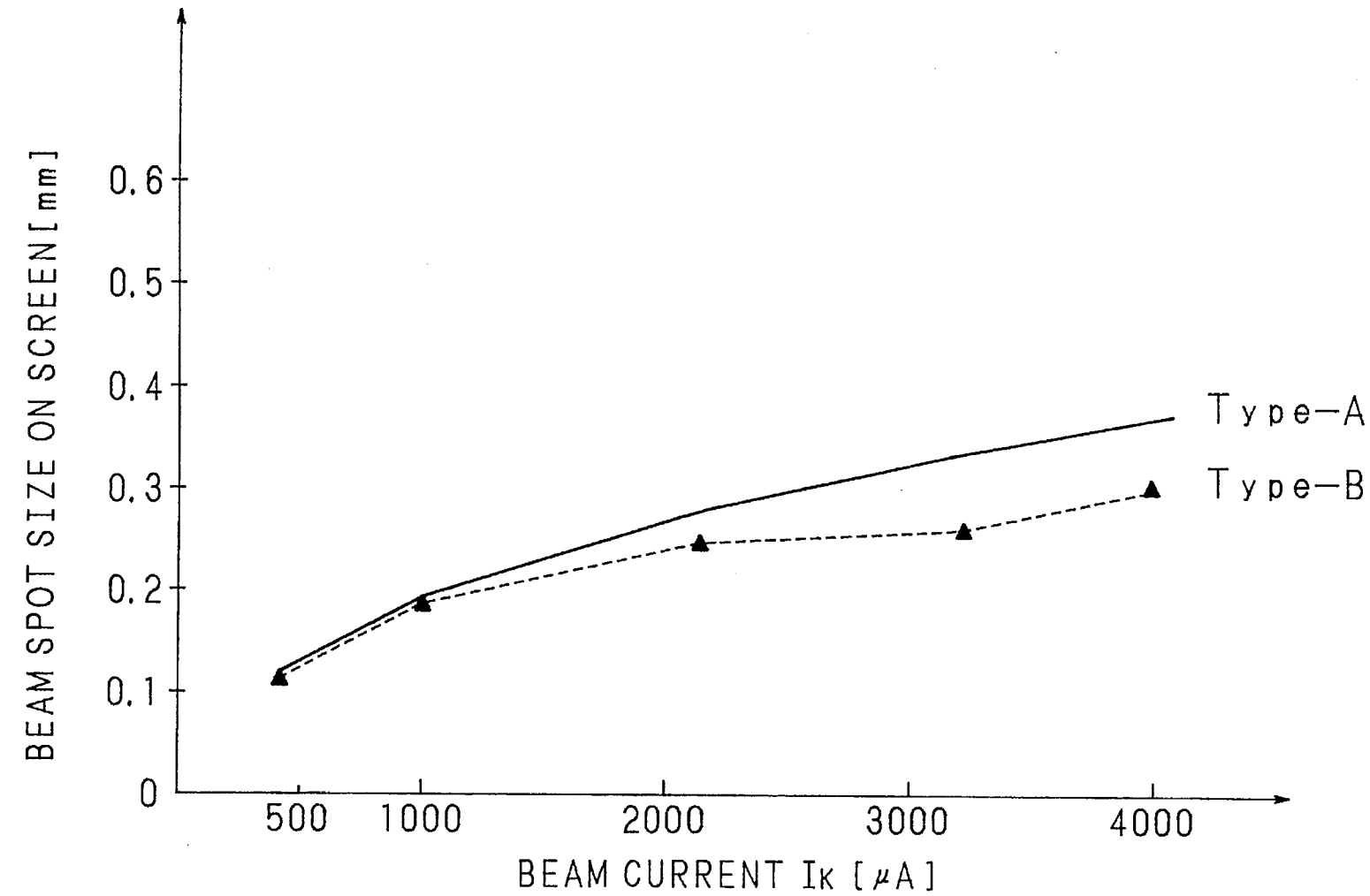
FIG. 13 is a graph showing the relationship between the beam current and the beam spot size at the center of the phosphor screen.
Figure 14:
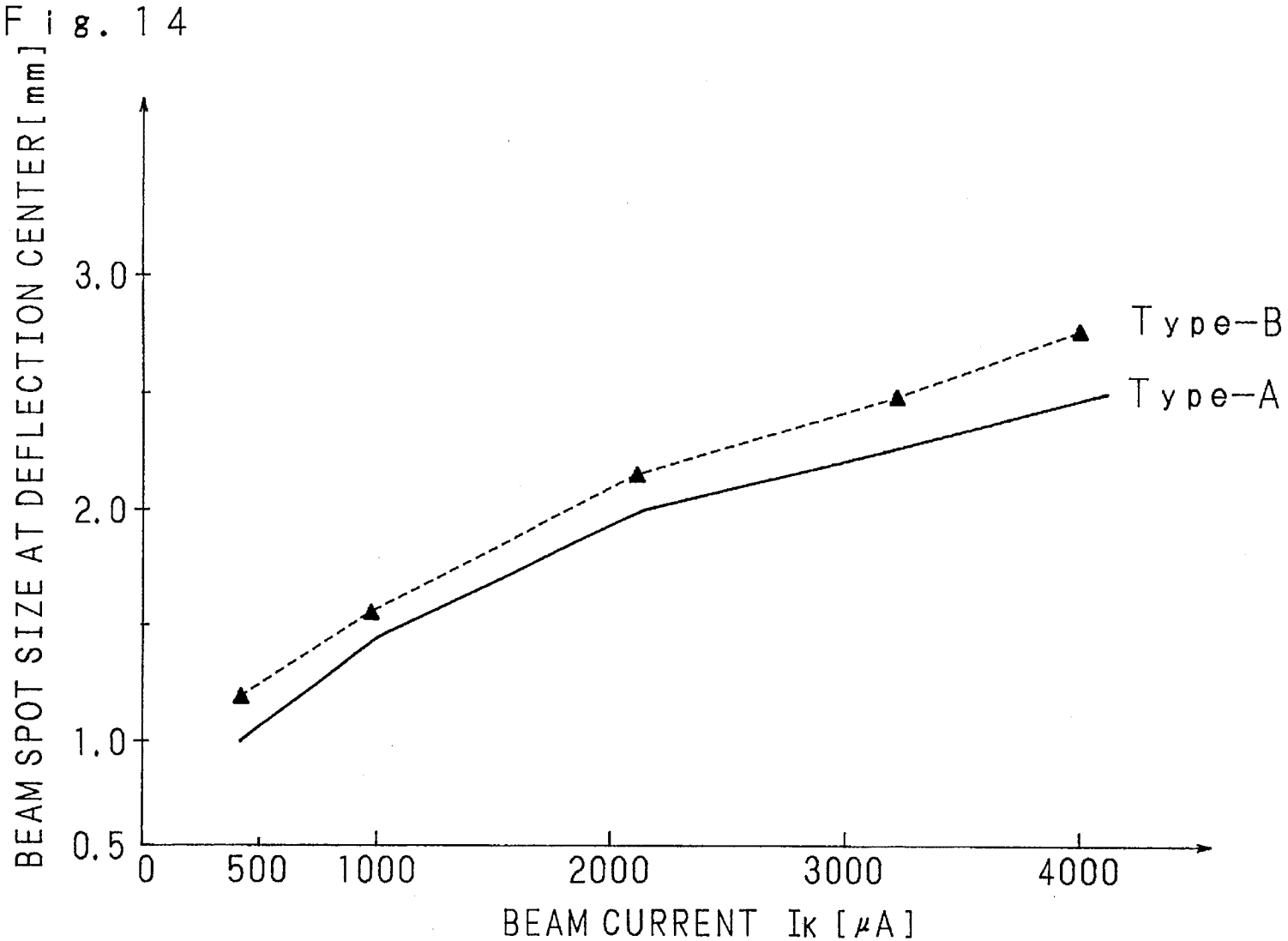
FIG. 14 is a graph showing the relationship between the beam current and the beam spot size at the deflection center.

FIG. 13 is a diagram showing the relationship between the beam current and the beam spot size at the center of the screen 10 for Type A with the thickness of 0.25 mm of the second grid 12 and the interval of 3.0 mm between the second grid 12 and the third grid 13 (axial potential gradient of 10 kV/mm) and for Type B with the 0.25 mm thickness of the second grid 12 and the interval of 2.0 mm between the second grid 12 and the third grid 13 (axial potential gradient of 15 kV/mm). The ordinate represents the beam spot size on the screen, and the abscissa the beam current value. FIG. 14 is a graph showing the relationship between the beam current and the beam size at the deflection center for Type A and Type B. In this graph, the ordinate represents the beam size at the deflection center, and the abscissa the beam current value. These graphs are prepared by the beam trajectory analysis and the electromagnetic field analysis on the computer (5% profile). The beam spot size at the peripheral portion of the phosphor screen 10 is estimated from the beam spot size at the deflection center proportional to the beam spot size. More specifically, the larger the beam spot size at the deflection center, the greater the liability to be affected by the deflection magnetic field, thereby increasing the beam spot size deflected to the peripheral portion of the phosphor screen 10.

As is evident From FIG. 13, Type B with the interval of 2 mm exhibits a superior focusing performance with a small beam spot size at the center of the phosphor screen 10 the high current region. In the case of Type B, however, as shown in FIG. 14, the beam spot size at the periphery of the phosphor screen 10 is larger than for Type A, and therefore a deteriorated focusing is caused at the peripheral portion of the phosphor screen 10.

In order to reduce the beam spot size at the peripheral portion of the phosphor screen 10, the thickness of the second grid 12 is increased as compared with that for the above-mentioned embodiment.

Figure 15:
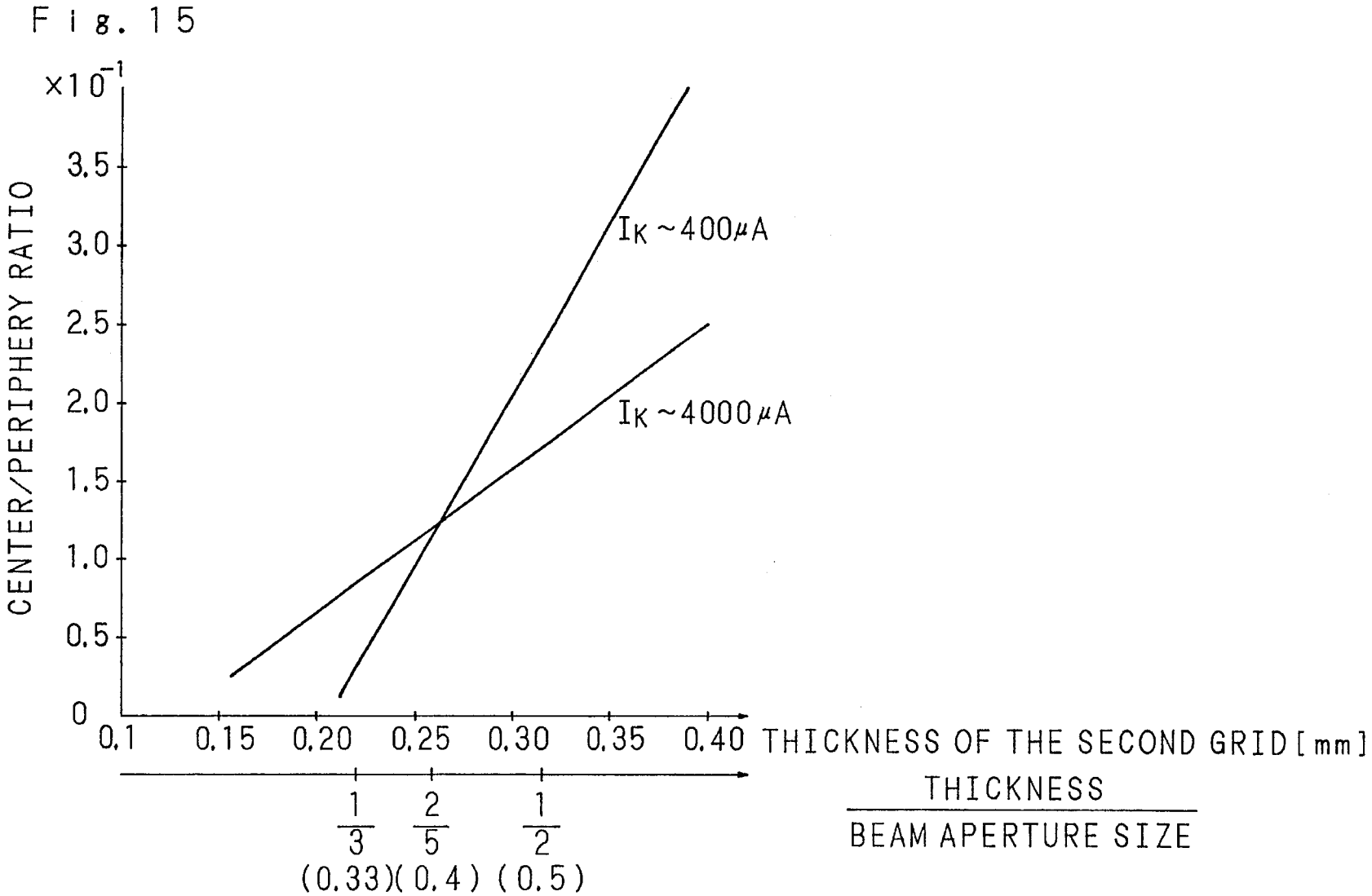
FIG. 15 is a graph showing the relationship between the center/periphery ratio and the thickness of the second grid.

FIG. 15 is a graph showing the relationship held between the center/periphery ratio of the beam spot size on the phosphor screen 10 and the thickness of the second grid 12 in the low-beam current region (400 μA) and the high-beam current region (4000 μA). The ordinate represents the center/periphery ratio of the beam spot size, and the abscissa the ratio between the thickness of the second grid 12 and the beam aperture size (0.64 mm) together with the thickness of the second grid 12. The interval between the second grid 12 and the third grid 13 is 2.0 mm (axial potential gradient: 15 kV/mm).

It is seen from FIG. 15 that the center/periphery ratio sharply increases with the increase in the thickness of the second grid 12 in the low-beam current region, while the increase in the center/periphery ratio is gentler in the high-beam current region. The center/periphery ratio between the low- and high-beam current regions becomes substantially equal to each other in the vicinity of 0.26 mm.

Figure 16:
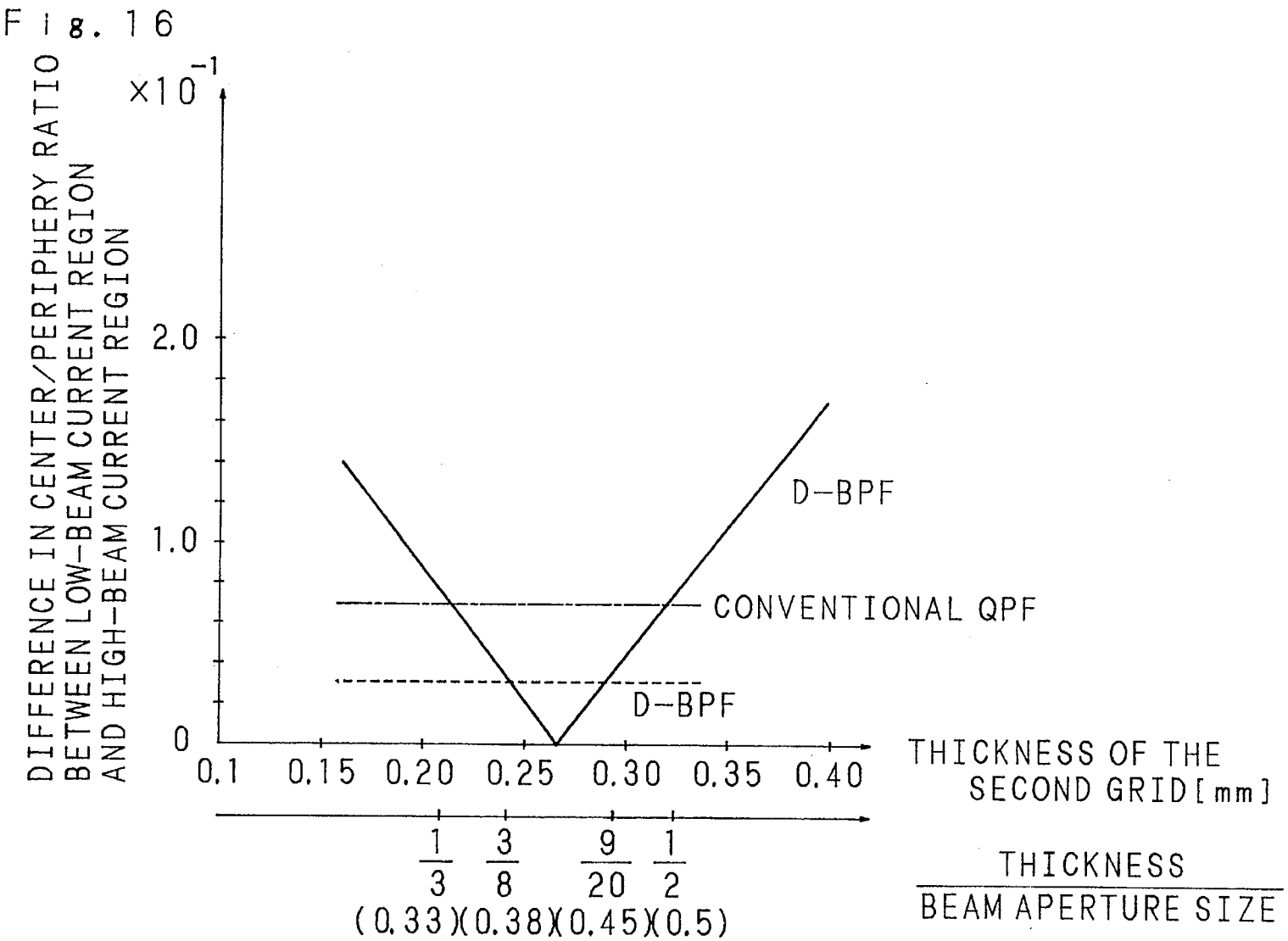
FIG. 16 is a graph showing the relationship between the difference in center/periphery ratio between high- and low-current regions and the thickness of the second grid.

FIG. 16 is a graph showing the difference in center /periphery ratio between the low-beam current region and the high-beam current region. The solid line represents the embodiment (axial potential gradient: 15 kV/mm), the dashed line the above-mentioned embodiment (axial potential gradient: 10 kV/mm), and the one-dot chain the conventional QPF type. As will be apparent from FIG. 16, the thickness of the second grid 12 about one third to one half of the beam aperture produces a satisfactory result as compared with the conventional QPF type, and the thickness of the second grid 12 about ⅜ to 9/20 of the beam aperture size results in an implementation superior to the above-mentioned embodiment.

If the focusing performance of the central portion of the phosphor screen is to be improved in the high current region in this way, the potential gradient between the second grid 12 and the third grid 13 is increased beyond 13 kV/mm. Further, the difference in focus performance between the central and peripheral portions of the phosphor screen 10 is reduced by improving the focusing performance for the peripheral portion with the thickness of the second grid set to about one third to one half, or preferably, to about ⅜ to 9/20 of the beam aperture size.

According to the embodiment under consideration, the potential gradient between the second grid 12 and the third grid 18 is maintained at least 13 kV/mm, whereby the electron beam in the beam-forming region is sharply accelerated thereby to suppress the expansion of the electron beam. As a result, the space charge effect in the high-beam current region in particular is reduced, so that the change of the beam spot size with the beam current is reduced, thereby realizing an improved image quality and brightness.

Further, when the thickness of the second grid 12 is about ⅛ to ½ of the beam aperture size, or preferably, about ⅜ to 9/20, the beam size at the deflection center can be reduced. Consequently, the beam spot size at the peripheral portion of the phosphor screen 10 is proportionately reduced, so that the beam spot size ratio between the central portion and the peripheral portion of the phosphor screen 10 can be reduced, thereby further contributing to an improved image quality.

As explained above, according to this invention, both the early stage lens unit and the main lens unit are respectively configured as a bipotential form lens, and at the same time one of the grids making up the early stage lens unit is impressed with a high voltage substantially identical to the voltage applied to one of the grids of the main lens unit. As a consequence, the electrons are sharply accelerated thereby to reduce the space charge effect. This suppresses the synergistic effect of the space charge and spherical aberration with the increase in current, reduces the change in beam spot size with the change in beam current, improves the image quality at the high-beam current region, and thus can brighten the image proportionately.

Also, in the case where the early stage lens unit is configured as a deceleration-type bipotential form lens and is combined with the main lens unit of a conventional large-sized composite lens for the cathode-ray tube, the bipotential form lens characteristic of the main lens unit of the conventional cathode-ray tube electron gun can be matched with that of the early stage lens unit of the cathode-ray tube electron gun according to the invention. In this way, the superior characteristics of the respective lenses can be maintained thereby to keep the lens action of the two lenses independent of each other.

Further, the fact that one of the grids making up the early stage lens unit is located in the vicinity of an annular grid of the cathode prefocusing lens unit reduces the imaginary object point size sufficiently, thereby reducing the beam spot size on the object of projection.

Also, the excessive focusing strength of the early stage lens unit and increase of magnification, as well as deterioration of emittance characteristic and undesirable blooming can be suppressed, thereby to control the lens action as a deceleration type bipotential form lens in the early stage lens unit.

Furthermore, the axial potential gradient between an annular grid constructing the cathode prefocusing lens unit providing an accelerating electrode and a grid constructing the early stage lens unit located on the projection object side of the annular grid is maintained at least 13 kV/mm, so that the electron beam in the beam-forming region is sharply accelerated to suppress the expansion of the electron beam. In particular, the space charge effect in the high-beam current region is reduced to decrease the change in the beam spot size with the bean current, thereby improving the image quality and brightness.

In addition, the thickness of the above-mentioned annular grid making up the cathode prefocusing lens unit is maintained at about ⅓ to ½ of the beam aperture size, whereby the beam size at the deflection center is reduced. As a result, the beam spot size at the peripheral portion on the object of projection is proportionately reduced, and therefore the ratio of the beam spot size between the central portion and the peripheral portion of the object is reduced, thereby contributing to a great advantage of the invention such as an even more improved image quality.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such meters and bounds thereof are therefore intended to be embraced by the claims.

What is claimed is:

1. A cathode-ray tube electron gun comprising:

a cathode for emitting an electron beam;

a cathode prefocusing lens unit, located adjacent to said cathode, including a first plurality of grids having electron beam apertures for passage of the electron beam;

an early stage lens unit, located adjacent to said cathode prefocusing lens unit, including a second plurality of grids having electron beam apertures configured as a first bipotential form lens; and a main lens unit, located adjacent to said early stage lens unit, including a third plurality of grids having electron beam apertures configured as a second bipotential form lens independent from said first bipotential form lens;

wherein said early stage lens unit and said main lens unit include a common grid, and a length of the common grid is at least about 5.6 times larger than an aperture size located at the early stage lens unit side of the common grid.

2. A cathode-ray tube electron gun according to claim 1, wherein a thickness of an annular grid included in said first plurality of grids in said cathode prefocusing lens unit is no more than one half of an aperture size thereof.

3. A cathode-ray tube electron gun according to claim 1, wherein a length of a grid included in said second plurality of grids in said early state lens unit is no more than one half of the aperture size on the main lens unit side thereof.

4. A cathode-ray tube electron gun according to claim 1, wherein an axial potential gradient between an annular grid included in said first plurality of grids in said cathode prefocusing lens unit and a grid included in said second plurality of grids in said early stage lens unit is at least about 13 kV/mm.

5. A cathode-ray tube electron gun according to claim 4, wherein a thickness of the annular grid making up said cathode prefocusing lens unit is substantially one third to one half of an aperture size thereof.

6. A cathode-ray tube electron gun according to claim 4, wherein a thickness of a the annular grid is substantially ⅜ to 9/20 of an aperture size thereof.

7. An electron gun for a cathode-ray tube comprising:

a cathode for emitting an electron beam;

a cathode prefocusing lens unit formed at least by a first grid disposed adjacent to said cathode having a first aperture for passing the electron beam, and a second grid disposed adjacent to said first grid having a second aperture for passing the electron beam;

an early stage lens unit formed at least by said second grid and a third grid disposed adjacent to said second grid having a third aperture for passing the electron beam;

a main lens unit formed at least by said third grid and a fourth grid disposed adjacent to said third grid, having a fourth aperture for passing the electron beam; and wherein, a length of the third grid is at least about 5.6 times larger than a diameter of said third aperture.

8. An electron gun for a cathode-ray tube according to claim 7, wherein a first voltage is applied to said second and fourth grids, and a second voltage, lower than the first voltage, is applied to said third grid.

9. An electron gun for a cathode-ray tube according to claim 7, wherein a thickness of said first grid is equal to or smaller than one half a diameter of said first aperture.

10. An electron gun for a cathode-ray tube according to claim 7, wherein a length of said second grid is equal to or smaller than one half the diameter of said third aperture.

11. An electron gun for a cathode-ray tube according to claim 7, wherein an axial potential gradient between said first grid and said second grid is at least about 13 KV/mm.

12. An electron gun for a cathode-ray tube according to claim 11, wherein a thickness of said first grid is substantially one third to one half of a diameter of said first aperture.

13. An electron gun for a cathode-ray tube according to claim 11, wherein a thickness of a said first grid is substantially ⅜ to 9/20 of the diameter of said first aperture.

14. A method for improving resolution of an electron beam in a cathode-ray tube including a cathode for emitting the electron beam, a cathode prefocusing lens unit formed adjacent to said cathode, an early stage lens unit formed adjacent to said cathode prefocusing lens unit, a main lens unit formed adjacent to said early stage lens unit, comprising the step of:

forming said early stage lens unit by a first grid disposed adjacent to said cathode prefocusing lens unit and a second grid disposed adjacent to said first grid;

forming said main lens unit by said second grid and a third grid disposed adjacent to said second grid; and forming a length of the second grid at least about 5.6 times larger than a diameter of an aperture located at the early stage lens unit side of the second grid.

15. The method of claim 14, further comprising the step of:

applying a first voltage to said first and third grids; and applying a second voltage, lower than the first voltage, to said second grid.

16. The method of claim 14, further comprising the step of:

limiting a thickness of the first grid forming said cathode prefocusing lens unit to no more than one half of a diameter of an aperture of said first grid.

17. The method of claim 14, further comprising the step of:

limiting a length of the second grid forming said early stage lens unit to no more than one half of a diameter of an aperture of said second grid.

18. The method of claim 14, further comprising the step of:

applying at least about 13 KV/mm of an axial potential gradient between the first grid forming said cathode prefocusing lens unit and the second grid forming said early stage lens unit.

19. The method of claim 18, comprising the step of:

limiting a thickness of said first grid substantially between one third to one half of a diameter of an aperture of said first grid.

* * * * *